US006082313A

United States Patent [19]

Leijonberg

[11] Patent Number: 6,082,313

[45] Date of Patent: Jul. 4, 2000

[54] POWER MACHINE LUBRICATION

[75] Inventor: Gunnar Leijonberg, Huskvarna, Sweden

[73] Assignee: Gul & Co Development AB, Huskvarna, Sweden

[21] Appl. No.: 09/228,236

[22] Filed: Jan. 11, 1999

Related U.S. Application Data

[63] Continuation of application No. PCT/SE97/01261, Jul. 10, 1997.

[30] Foreign Application Priority Data

Jul. 12, 1996 [SE] Sweden ..... 9602759

[51] Int. Cl.[7] ..... F02B 75/26

[52] U.S. Cl. ..... 123/52.2; 123/51 R

[58] Field of Search ..... 123/51 B, 51 A, 123/51 R, 52.2, 52.5, 53.4, 53.6, 73 R, 73 AG, 73 PP, 74 A

[56] References Cited

U.S. PATENT DOCUMENTS 1,603,969 10/1926 Michel ..... 123/51 B 5,031,581 7/1991 Powell ..... 123/51 B

*Primary Examiner*—Marguerite McMahon

*Attorney, Agent, or Firm*—Pillsbury Madison & Sutro LLP

[57] ABSTRACT

The present invention is for the kind of power machines, engines, pumps or compressors which have two or more pistons which work against each other, preferably with a common combustion chamber or corresponding, in a stationary cylinder and where the power is transmitted to or from a rotating motion without an intermediate cam shaft. One such device has two parallel discs, both a stationary disc and a relatively thereto rotating disc in which there are stationary and rotating tracks. Balls move in the tracks. Between the inside of the housing and the outer edges of the discs there is a comparatively narrow slit. Lubricant which is present inside the housing is affected by the rotating disc so that the lubricant is forced out towards the inside of the housing. In order to supply lubricant to the rotating balls and from these to the rotating and stationary tracks holes and channels have been made within or adjacent to the ballholders and the stationary tracks.

3 Claims, 5 Drawing Sheets

POWER MACHINE LUBRICATION

This is a Continuation of International Appln. No. PCT/SE97/01261 filed Jul. 10, 1997 which designated the U.S.

BACKGROUND OF THE INVENTION

The present invention is for the kind of power machines, engines, pumps or compressors which have two or more pistons which work against each other, preferably with a common combustion space in a stationary cylinder and where the power is transmitted to or from a rotating motion without an intermediate crankshaft.

There are special problems with the lubrication of the parts of the power transmission without having to equip the device with complicated and costly auxiliary systems.

In combustion engines the transmission of power from a to and fro (i.e., reciprocating) motion to a rotating motion generally is by means of some kind of crankshaft or the like device. In some cases however, crankshafts are less suitable, and this is especially the case when to and fro motions of different, often directly opposite directions, together shall be transmitted to a rotating motion. Especially this holds for the kind of power machines i.e. combustion engines, compressors and pumps where two pistons at the same time work against each other in a common cylinder bore. The use of crankshaft in these cases brings with it complicated mechanical designs in order to join the power from the two pistons to a common rotating motion. The transmission of power between a to and fro motion and a rotating motion may instead take place by means of a ballbearing which runs in several tracks and comprises a ball which is surrounded by a ballholder which is attached to a piston rod or corresponding device for each ball for transmission of the linear motion to a rotating motion. It is also possible to substitute the balls for other means with corresponding function, for example rolls or pins which roll or slide in the tracks.

One such device has two parallel plane discs, both a stationary disc and one relatively thereto rotating disc. In a cylinder which is positioned centrally relative to the discs there are two pistons which are working pistons in a combustion engine having a common combustion chamber. Permanently joined to each piston is a piston rod which in its opposite end has a holder means for the ball by means of which the power from the to and fro motion is transmitted to the rotating disc. The balls also serve as bearing between the stationary disc and the rotating disc. The rotating disc is mounted to a holder which in its turn is mounted onto an outgoing shaft from which the rotating power is taken for use for various driving purposes. The balls can move both in linear tracks in the fixed disc and in a common elliptic or otherwise closed shaped track in the rotating disc. It is also possible to substitute the balls for other means having a corresponding function, for example rolls or pins which roll or slide in the tracks. In other embodiments the tracks can be substituted for by raised edges forming contact surfaces for e.g. roller or slide bearings on the sides of the edge.

It is important for the function of the device that there is a satisfactory lubrication between the ball and holder and between the ball and the tracks wherein the balls move, or other means having corresponding functions.

SUMMARY OF THE INVENTION

The present invention is for a method and means for obtaining a sufficient lubrication. It is characteristic for the invention that sufficient lubrication is obtained thereby that rotational energy of the lubricant, which rotates under influence of the rotating disc, partly is converted to static pressure.

DESCRIPTION OF THE DRAWINGS

The invention will below be described more in detail with reference to the embodiment which is shown in the enclosed figures.

DETAILED DESCRIPTION

Figure 1:
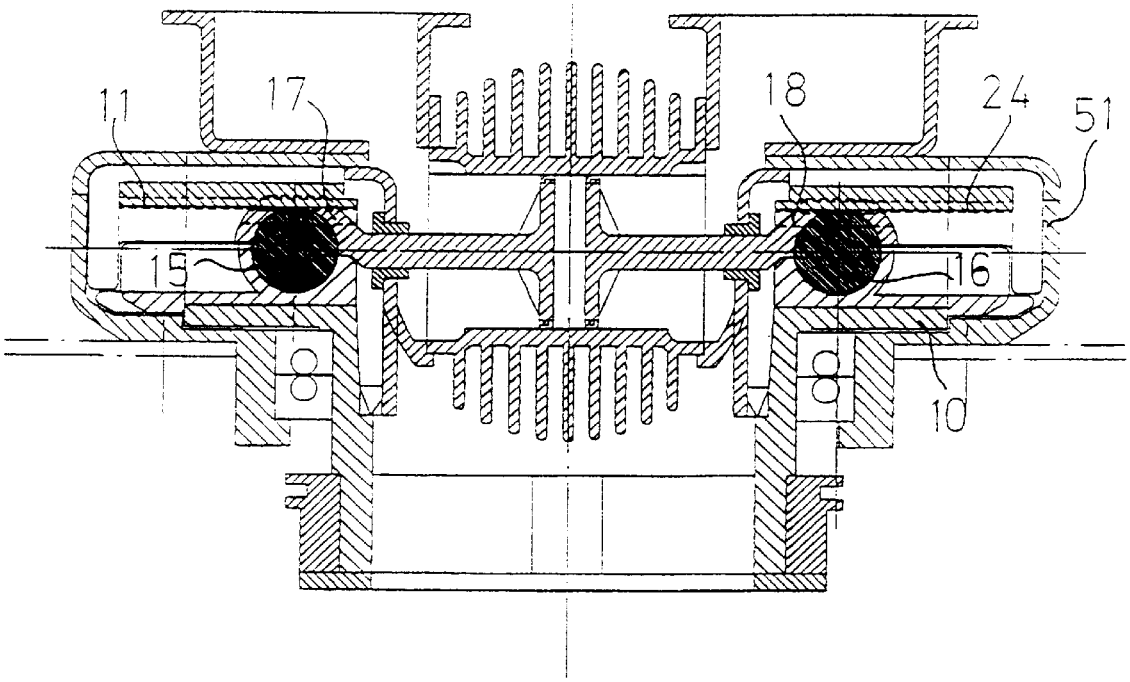
FIG. 1 shows a combustion engine having devices according to the invention.
Figure 2:
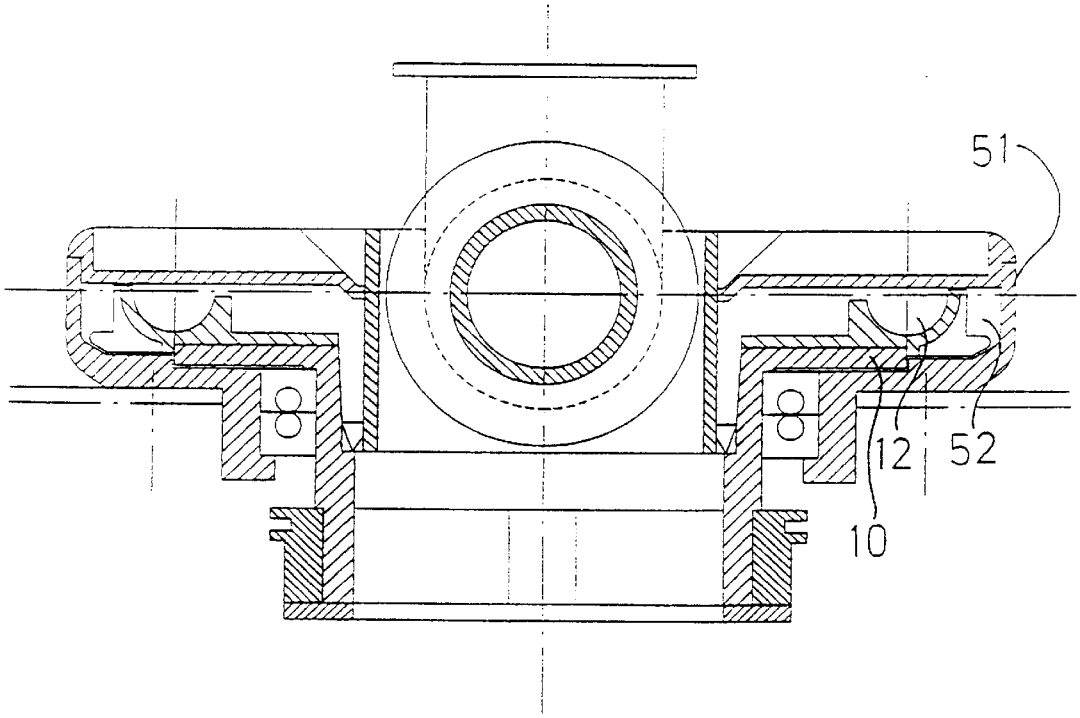
FIG. 2 shows a device of FIG. 1 in cross-section at right angle to FIG. 1.
Figure 3:
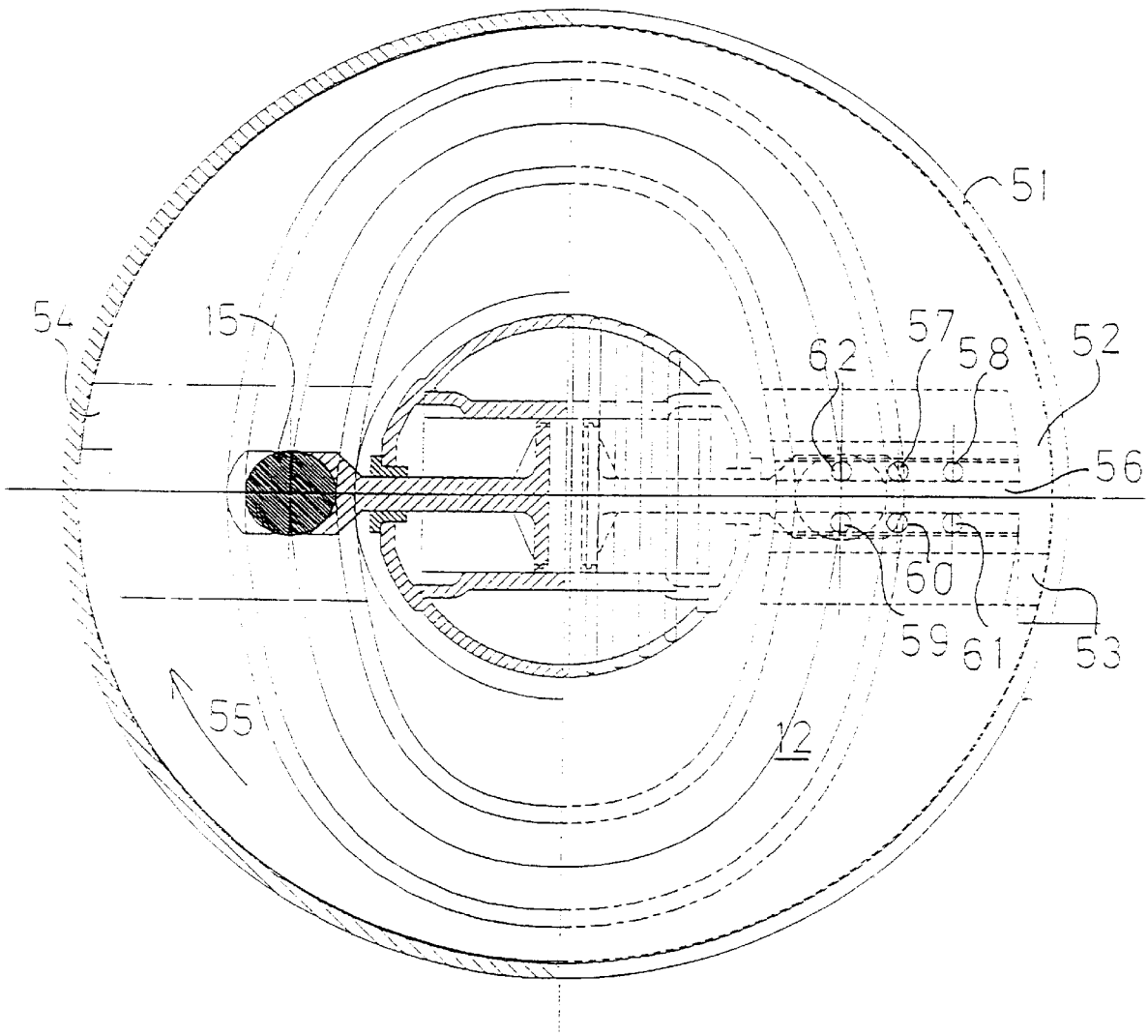
FIG. 3 shows the engine of FIGS. 1 and 2 partly in cross-section in a plane parallel with that of the rotating disc.
Figure 4:
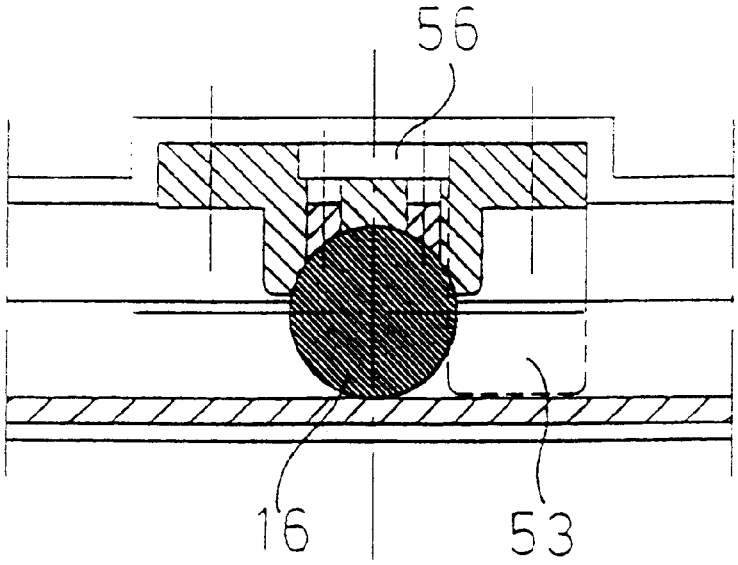
FIG. 4 shows a cross-section through a ball, a ball holder and adjacent parts of the device.

The device shown in the figure has two parallel plane discs, one which is named stationary disc 8 and one relatively thereto rotating disc 10. The stationary disc 8 is carried by a housing and the disc 8 in its turn carries in its centre a cylinder having end walls. In the cylinder there are two pistons which are working pistons, and in a combustion engine preferably have a common combustion chamber.

Permanently joined to each piston is a piston rod which at its opposite end has a holder means 17, 18 for the ball 15, 16 by which the power from the to and fro motion is transmitted to the rotating disc 10. The balls 15, 16 also serve as bearing between the stationary disc 8 and the rotating disc 10. In a preferred embodiment of the invention the centre axis of the cylinder bore coincides with the line of movement of the balls. The balls 15, 16 can move both in linear tracks 11, 24 in the fixed disc and in a common elliptic track 12 in the rotating disc.

At the centre of the cylinder bore and adjacent to the upper dead centre, UDC, of the pistons and at opposite sides thereof valves may be arranged. In the cylinder there are valve seats and the shafts are designed with consideration of the borings and bushings which are present in the stationary parts adjacent to the cylinder. Preferably the valve shafts at their far ends from the cylinder directly contact a control curve or surface which is a part of the rotating disc.

The rotating and stationary discs are surrounded by an outer housing 51, which surrounds the outsides of the discs and at least partly their adjacent upper and lower sides. Between the inside of the housing and the outer edges of the discs there is a comparatively narrow slit 52. Lubricant, preferably oil which is inside the housing is affected by the rotating disc so that lubricant is forced out towards the inside of the housing and rotates along it in the same direction as the rotating disc. In order to supply lubricant to the rotating balls 15–16 and from these to the rotating and stationary tracks holes and channels have been made in or adjacent to the ballholders and the stationary tracks. The lubricant is directed into these channels by means of protruding means forming stop lugs 53, 54 for the lubricant. Preferably these stop lugs are integrated parts of the stationary disc closed to the stationary tracks therein. In the embodiment shown in the figures the lubrication channels have been made parallel to the plane of the rotating disc and in a direction which is parallel to the direction of movement of the balls and pistons. At right angle to the channels 56 there have been made several smaller lubrication channels 57, 58, 59, 60, 61, 62 which open to the stationary track and through which lubricant can be directly supplied to the ball and the ball holder.

Lubricant also flows inwards towards the centre through a slit 91 to lubricate the valve mechanism. For lubrication of the elliptic track 12 lubricant is directed over the slit 92 to a spreading border 93, from which a curtain of lubricant lubricates the track 12.

When the rotating disc 10 rotates in the direction which is shown by the arrow 55, there is as mentioned above a flow of lubricant along the inside of the wall of the housing 51. The lubricant flows into the slit 52 between the rotating and the stationary discs. In the direction of rotation and immediately after the stationary tracks the flow of lubricant is stopped by the protruding lugs 53, 54. Thus lubricant is forced into the main channel 56 and therefrom further to the at right angle extending lubrication channels 57, 58, 59, 60, 61, 62. The lubricant then follows the rotating ball 15, 16 and in this way lubricates all contact surfaces in ball holder and track. The lubrication may be further improved by suitable design of the ball holder.

Figure 5:
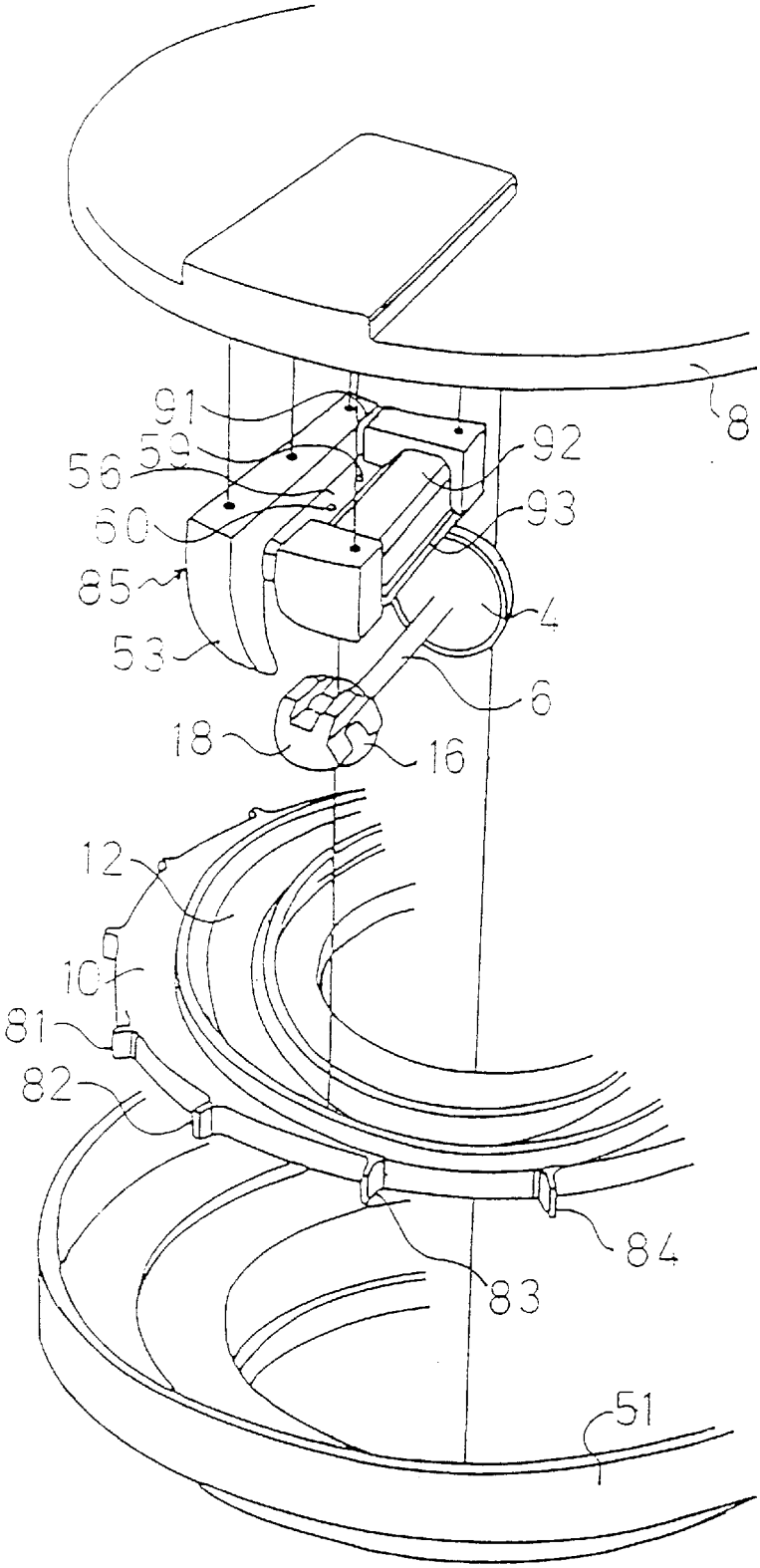
FIG. 5 shows the parts of the device in perspective.

One example of an embodiment of essential components of the device is shown in FIG. 5. In the figure the components are shown at distance from each other in order to better show their design. In the housing 51 there is the rotating disc 10 having an elliptic track 12. Along the periphery of the disc there are several protrusions 81, 82, 83, 84 of such an extension that they are very closed to the inside of the housing 51. The stationary disc 8 has in a separate part 85 a straight track which is not shown in the figure. The ball 16 runs both in the elliptic track 12 and in the straight track in the part 85 and is partly surrounded by a holder 18 which by means of a piston rod 6 is connected to the piston 4. At the part 85 there is a protruding lug 53 which is intended to catch the lubricant which rotates in the housing 51 and direct it to the lubrication channels 56, 59, 60. These channels open at the under side of the part 85 so that they in a suitable way can lubricate the ball 16 in the holder 18 and transfer lubricant to the linear track of the part 85. Further lubrication channels may be arranged as described above. In order to further improve the lubrication properties the edges of the holder where it contacts the ball 16 may be chamfered so that lubricant is brought along and for example is further supplied to the track 12.

Several advantages are obtained by the device described above by that the device is of simple design and no moving parts are required solely for the lubrication. A further advantage is that the lubrication will be on the hole independent of position and the lubricating system will work well both when the device is used for various kinds of tools, the use of which means repeated changes of position. The device may also simply be adapted to the direction of rotation of the rotating disc.

Within the inventive idea there may be various embodiments besides those which have been described above. The operation may be affected for example by the roughness of the surfaces which contact the lubricant and both the rotating and the stationary disc may have further tracks and lugs which are adapted to the design in question. Preferably the lubricant is oil, but in some applications it can be another liquid. In a special embodiment of the invention the lubricant is also a cooling medium and may be constituted by water with possible additives.

What is claimed is:

1. A power machine comprising:

a common cylinder having a bore formed therein;

two pistons disposed in said bore in opposed facing relation with respect to each other and being constructed and arranged to synchronously reciprocate within said bore in opposite respective directions;

a transmission mechanism for converting linear reciprocating movement of said two pistons into a rotating movement, said transmission mechanism including a stationary disc and a rotating disc, said rotating and stationary discs being operatively coupled to each other and to said two pistons to convert reciprocating movement of said pistons into rotation of said rotating disc, said stationary disc having lubricant transmitting channels formed therein;

a housing surrounding said stationary and rotating discs; and at least one protruding lug extending from said stationary disc into a space between an inner surface of said housing and an outer periphery of said stationary disc, said protruding lug being constructed and arranged to urge lubricant from said space into said lubricant transmitting channels during rotation of said rotating disc.

2. The power machine of claim 1, said lubricant transmitting channels comprising at least one main channel extending radially inwardly from the outer periphery of said stationary disc.

3. The power machine of claim 1, further comprising a plurality of spaced-apart protrusions projecting outwardly from an outer periphery of said rotating disc and into a space between an inner surface of said housing and an outer periphery of said rotating disc.

* * * * *